US007748603B2

(12) United States Patent
Fogle et al.

(10) Patent No.: US 7,748,603 B2
(45) Date of Patent: Jul. 6, 2010

(54) CARTON WITH HANDLE

(75) Inventors: James C. Fogle, Marietta, GA (US); Jean-Manuel Gomes, Marietta, GA (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 661 days.

(21) Appl. No.: 11/616,149

(22) Filed: Dec. 26, 2006

(65) Prior Publication Data

US 2007/0164091 A1 Jul. 19, 2007

Related U.S. Application Data

(60) Provisional application No. 60/753,912, filed on Dec. 23, 2005.

(51) Int. Cl.

| | |
|---|---|
| ***B65D 5/00*** | (2006.01) |
| ***B65D 5/46*** | (2006.01) |
| ***B65D 5/24*** | (2006.01) |
| ***B65D 65/00*** | (2006.01) |
| ***B65D 75/00*** | (2006.01) |

(52) U.S. Cl. ..... 229/101; 229/117.12; 229/186; 229/117.14; 229/117.19; 229/117.13; 206/427; 206/428

(58) Field of Classification Search ..... 229/101, 229/117.12, 117.19, 186, 117.13, 117.14; 206/427, 428

See application file for complete search history.

(56) References Cited

U.S. PATENT DOCUMENTS

| | | | | |
|---|---|---|---|---|
| 1,253,193 | A * | 1/1918 | Hill | 229/117.12 |
| 2,810,506 | A | 10/1957 | Kessler | |
| 2,868,433 | A | 1/1959 | Anderson, Jr. | |
| 2,955,739 | A | 10/1960 | Collura | |
| 3,112,856 | A | 12/1963 | MacIntosh et al. | |
| 4,036,423 | A | 7/1977 | Gordon | |
| 4,328,923 | A | 5/1982 | Graser | |
| 4,378,905 | A | 4/1983 | Roccaforte | |
| 4,498,619 | A | 2/1985 | Roccaforte | |
| 4,546,914 | A | 10/1985 | Roccaforte | |
| 4,588,084 | A | 5/1986 | Holley, Jr. | |
| 5,020,337 | A | 6/1991 | Krieg | |
| 5,292,058 | A | 3/1994 | Zoss et al. | |
| 5,297,725 | A * | 3/1994 | Sutherland | 229/117.13 |
| 5,333,734 | A * | 8/1994 | Stout et al. | 206/427 |
| 5,495,727 | A | 3/1996 | Strong et al. | |
| 5,582,343 | A | 12/1996 | Dalvey | |
| 5,639,017 | A | 6/1997 | Fogle | |
| 5,738,273 | A * | 4/1998 | Auclair | 229/117.13 |

(Continued)

FOREIGN PATENT DOCUMENTS

DE 20 2004 018 649 U1 4/2005

(Continued)

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton has a handle that allows a user to carry the carton when closed, and that extends to allow a user to carry the carton when the carton is in an open configuration. The carton includes gusseted end panels that create a partially closed bottom receptacle in the opened carton.

23 Claims, 9 Drawing Sheets

U.S. PATENT DOCUMENTS

| | | | | |
|---|---|---|---|---|
| 5,796,778 | A | 8/1998 | Kurker | |
| 5,873,515 | A | 2/1999 | Dunn et al. | |
| 5,915,546 | A | 6/1999 | Harrelson | |
| 5,992,733 | A | 11/1999 | Gomes | |
| 6,065,590 | A | 5/2000 | Spivey | |
| 6,164,526 | A | 12/2000 | Dalvey | |
| 6,631,803 | B2 * | 10/2003 | Rhodes et al. | 206/427 |
| 6,926,193 | B2 | 8/2005 | Smalley | |
| 2006/0273143 | A1 | 12/2006 | Finch | |
| 2007/0051781 | A1 | 3/2007 | Holley, Jr. | |

FOREIGN PATENT DOCUMENTS

| | | |
|---|---|---|
| WO | WO 2007/089282 | 8/2007 |

* cited by examiner

CARTON WITH HANDLE

CROSS-REFERENCE TO RELATED APPLICATIONS

This application claims the benefit of U.S. Provisional Application No. 60/753,912, filed Dec. 23, 2005, which is hereby incorporated by reference in its entirety.

BACKGROUND

Cartons for accommodating beverage containers and other articles are known. A conventional carton typically has a removable dispenser section that allows containers to be dispensed through the dispenser opening formed when the dispenser section is removed. Alternatively, a carton may have an end panel or a side panel formed from flaps that can be separated to create a dispenser opening in the carton. Such cartons are often also provided with one or more handle apertures that allow the cartons to be carried. Conventional carton handles may, however, be cumbersome and/or unwieldy to use. Conventional cartons also must be refrigerated or otherwise cooled in order to maintain the carton contents at a desired temperature.

SUMMARY

According to a first embodiment of the invention, a carton comprises an extendable handle and gusseted end panels. The handle can be used to lift the carton when the carton is in a closed configuration, and can be extended to carry the carton when the carton is in an open or dispensing configuration. The gusseted end panels can be arranged to form a partially closed bottom receptacle in the bottom of the carton when the carton is in the opened configuration.

According to an aspect of the first embodiment, ice, cold water, additional containers, or other items can be placed in the carton through the opened top end. The bottom receptacle of the carton can be used to retain liquids, such as water resulting from melting ice, condensation, other liquids, and articles such as, for example, refuse, particulate matter, etc. The gusseted end panels pivot outwardly to provide additional volume for items such as ice to be placed in the bottom receptacle of the carton.

According to another aspect of the first embodiment, the extendable handle allows the carton to be carried using only one hand. The handle can be selected, for example, to have sufficient strength to carry the carton, containers accommodated in the carton, and additional items such as ice or cold water loaded into the carton after the carton has been opened.

According to yet another aspect of the first embodiment, the handle may be extended so that the opened top of the carton is wide enough to allow additional items to be easily placed in and removed from the carton. The handle may extend to a height such that it does not interfere with removal of and loading of articles into the carton.

According to yet another aspect of the first embodiment, the bottom receptacle can be constructed to have a height that extends above the bottom panel of the carton below which there are no seams sealed by glue or other adhesives. The bottom receptacle may therefore be liquid-tight.

Those skilled in the art will appreciate the above stated advantages and other advantages and benefits of various additional embodiments reading the following detailed description of the embodiments with reference to the below-listed drawing figures. It is within the scope of the present invention that the above-discussed aspects be provided both individually and in various combinations.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
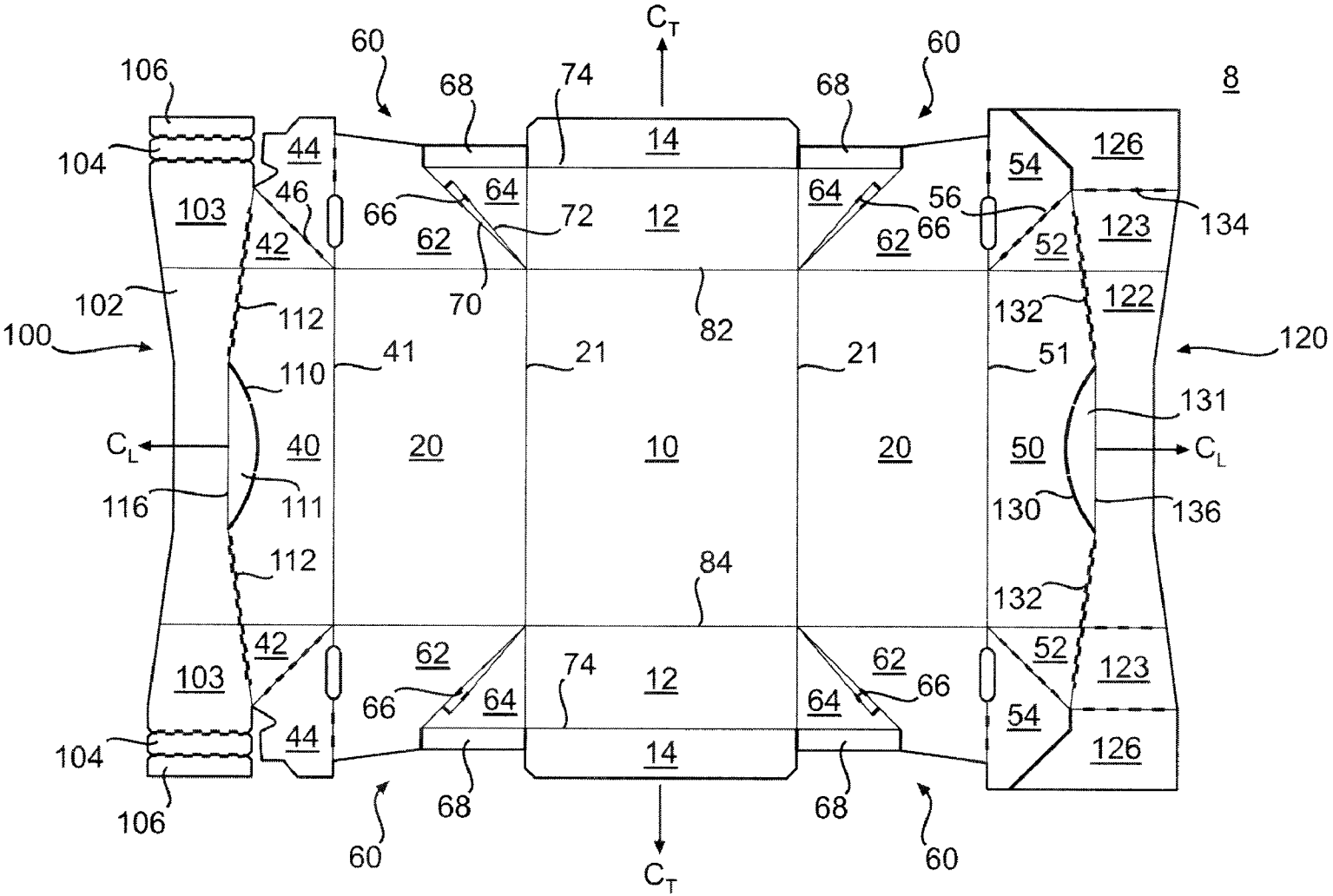
FIG. 1 is a plan view of a blank used to form a carton having a handle according to a first embodiment of the invention.

FIG. 1 is a plan view of a first side of a blank 8 used to form a carton 190 (illustrated in FIGS. 6 and 7) according to the first embodiment of the invention. As shown in FIG. 1, the blank 8 may have at least partial symmetry about a longitudinal center line CL and about a transverse center line CT. Therefore, certain elements in the drawing figures have similar or identical reference numerals in order to reflect the whole and/or partial longitudinal and transverse symmetries. The illustrated blank 8 is configured to form a carton for accommodating twelve containers C in a 3×4×1 (three columns and four rows) arrangement, although other container arrangements can be accommodated according to the principles of the present invention. In the illustrated embodiments, the containers C are twelve ounce beverage cans. Other container types, as well as other articles, may also be accommodated in the carton.

Figure 6:
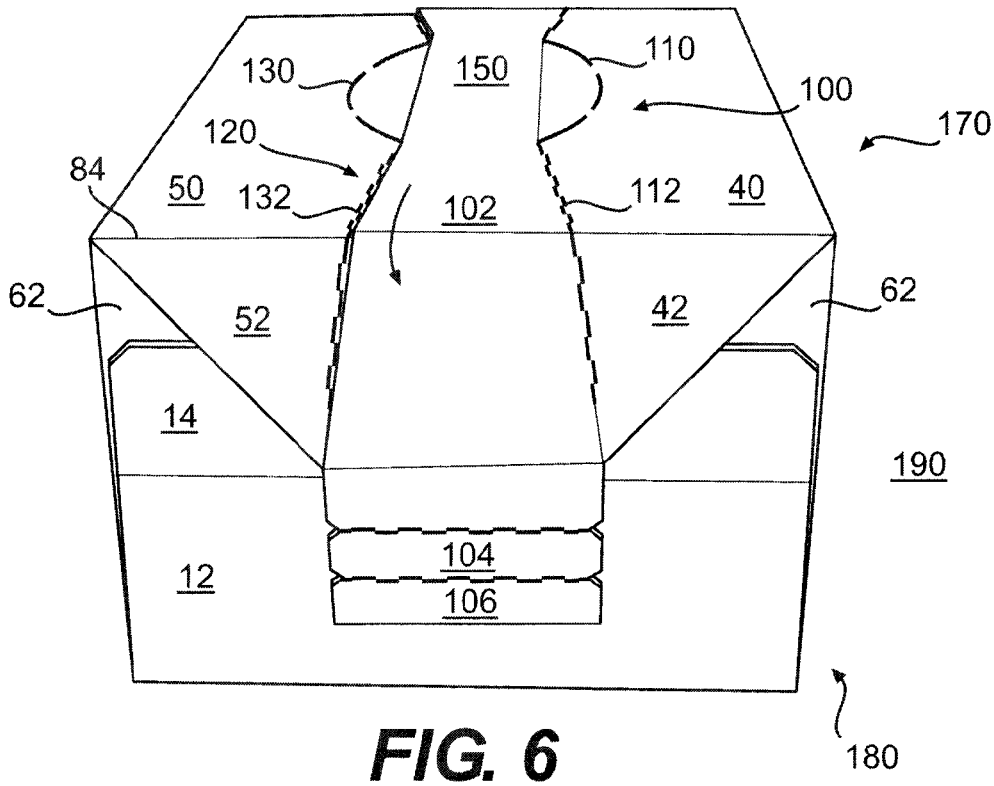
FIGS. 6 and 7 illustrate the first carton embodiment.
Figure 7:
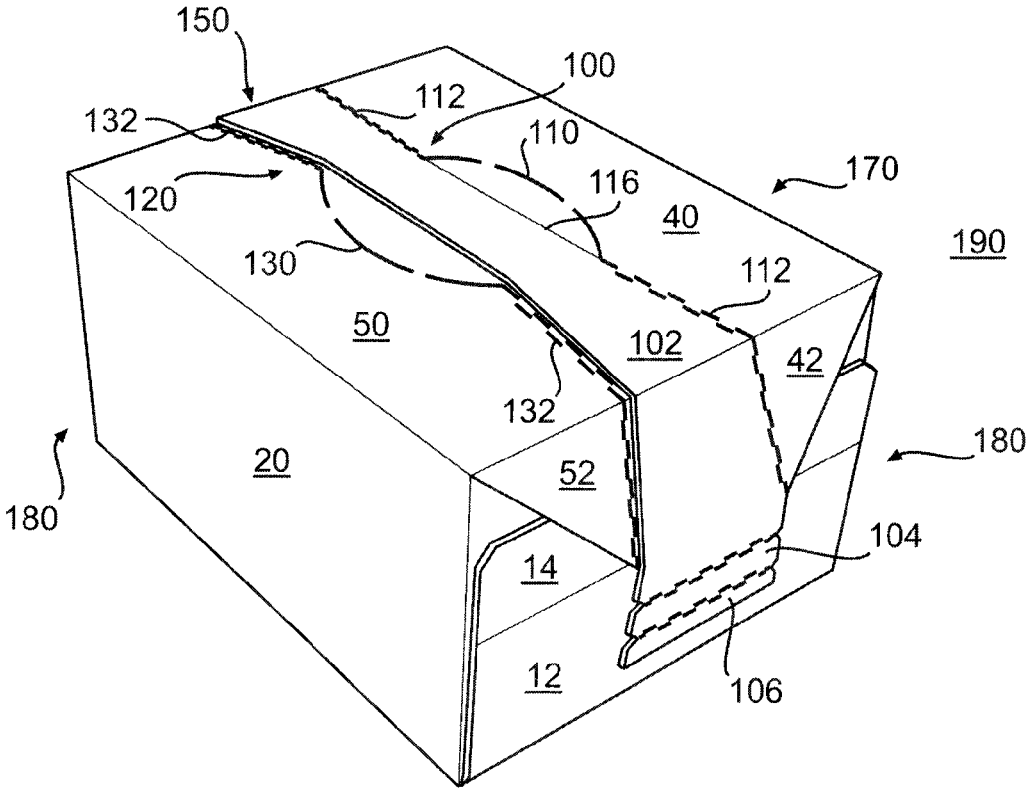

The blank 8 comprises a bottom panel 10 foldably connected to first and second side panels 20 at transverse fold lines 21, a first top panel 40 foldably connected to the first side panel 20 at a transverse fold line 41, and a second top panel 50 foldably connected to the second side panel 20 at a transverse fold line 51. The first and second top panels 40, 50 may be similar in shape and size and will partially overlap in the erected carton 190 (FIGS. 6 and 7).

First bottom end flaps 12 are foldably connected to opposite ends of the bottom panel 10 at first and second longitudinal fold lines 82, 84, respectively, and second bottom end flaps 14 are foldably connected to the first bottom end flaps 12 at longitudinal fold lines 74. The first and second longitudinal fold lines 82, 84 may be, for example, straight or substantially straight fold lines that extend across the entire length of the blank 8, or, the fold lines 82, 84 may be offset at one or more locations to account for, for example, blank thickness.

Four bottom gussets 60 are formed in the blank 8, one at each corner of the bottom panel 10. Two bottom gussets 60 extend along a first marginal area of the blank 8 and are connected at the longitudinal fold line 82. The other two bottom gussets 60 extend along a second marginal area of the blank 8 and are connected at the fold line 84. Each bottom gusset 60 comprises an interior gusset panel 62, a first exterior gusset panel 64, and a second, adhesive exterior gusset panel 68. The gusset panels 62, 64, 68 are defined in part by oblique fold lines 70, 72, and the fold lines 82, 84, 21, 41, 51. Intermediate gusset panels 66 are defined between the gusset panels 62, 64 by the oblique fold lines 70, 72 and by the fold lines 74.

The first top panel 40 includes two pairs of first upper gusset panels 42, 44, one pair of panels 42, 44 being foldably connected at each end of the first top panel 40. The first upper gusset panels 42 are foldably connected to a central section of the blank 8 at the first and second longitudinal fold lines 82, 84, respectively. Each first upper gusset panel 42 is foldably connected to an adjacent upper gusset panel 44 at an oblique fold line 46.

The second top panel 50 includes two pairs of second upper gusset panels 52, 54, one pair of panels 52, 54 being foldably connected at each end of the second top panel 50. The second upper gusset panels 52 are foldably connected to a central section of the blank 8 at the first and second longitudinal fold lines 82, 84, respectively. Each second upper gusset panel 52 is foldably connected to an adjacent upper gusset panel 54 at an oblique fold line 56.

According to one aspect of the present invention, the carton blank 8 includes a first handle section 100 and a second handle section 120 formed in the first and second top panels 40, 50, respectively. The first and second handle sections 100, 120 overlap and combine to form a multi-ply extendable handle 150 in the erected carton 190 (illustrated in FIGS. 6 and 7). The first and second handle sections 100, 120 of the blank 8 are discussed in detail below.

The first handle section 100 is defined in part in the first top panel 40 by two oblique tear lines 112 and a transverse fold line 116 connecting the oblique tear lines 112. A curved access line 110 may be disposed along the side of the first handle section 100 at the fold line 116 to provide access to the handle 150 in the erected carton 190. The access line 110 and the fold line 116 define a handle flap 111. The first handle section 100 includes a central section 102, opposed end sections 103, and opposed distal adhesive sections 106 located at opposite ends of the end sections 103. The adhesive sections 106 are separable from the end sections 103 by tear strips 104.

The second handle section 120 is defined in part in the second top panel 50 by two oblique tear lines 132 and a transverse fold line 136 connecting the tear lines 132. A curved access line 130 may be disposed along the side of the second handle section 120 at the fold line 136 to provide access to the handle 150 in the erected carton 190. The access line 130 and the fold line 136 define a handle flap 131. The second handle section 120 includes a central section 122, opposed end sections 123, and opposed distal sections 126 connected to the end sections 123 by longitudinal cut-space fold lines 134.

The lines 110, 112, 130, 132 can be breachable lines of disruption formed from, for example, continuous or substantially continuous tear lines formed by, for example, scores, creases, cuts, gaps, cut/creases, perforations, offset cuts, and combinations thereof. If cuts are used to form the breachable lines 110, 112, 130, 132, the cuts may be, for example, interrupted by breachable nicks. The cuts shown in FIG. 1 are illustrated as 100% cuts, which extend through the entire thickness of the blank 8. Partial cuts, which do not extend through the entire thickness of the blank 8, for example, may also be used.

An exemplary method of erecting the carton 190 from the blank 8 is discussed in detail below with reference to FIGS. 1-5. Erection of one end of the carton 190 is shown in FIGS. 2-5. The opposite end of the carton may also be erected in the manner shown in FIGS. 2-5.

Figure 2:
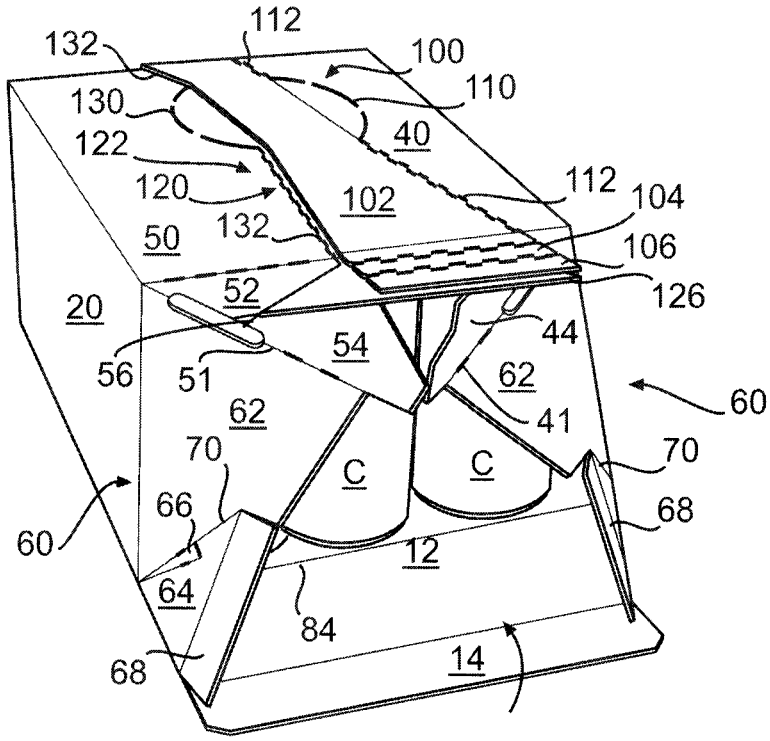
FIG. 2 illustrates the first carton embodiment in a partially erected state.

Referring to FIGS. 1 and 2, glue or other adhesive is applied to the upper or exterior side of the central section 122 of the second handle section 120 and/or to the interior or underside of the central section 102 of the first handle section 100. Containers C are wrapped within the blank 8 in a 3×4×1 arrangement as shown in FIG. 2. The first and second top panels 40, 50 are secured together by overlapping and adhering the first and second central handle sections 102, 122. The end sections 123 of the handle section 120 may also be adhered to corresponding end sections 103 of the handle section 100.

Referring to FIG. 2, the ends of the blank 8 are closed by folding the bottom gussets 60 and the upper gusset panels 42, 44, 52, 54 partially across the open end of the partially erected carton. The second upper gusset panels 52, 54 partially fold with respect to one another about the oblique fold line 56. The first upper gusset panels 42, 44 partially fold with respect to one another about the fold line 46. The panels 54, 62 partially fold with respect to one another about the fold line 51. The gusset panels 62, 64 partially fold with respect to one another about the oblique fold line 70. The adhered handle sections 100, 120 remain extended across the top of the partially erected carton.

Figure 3:
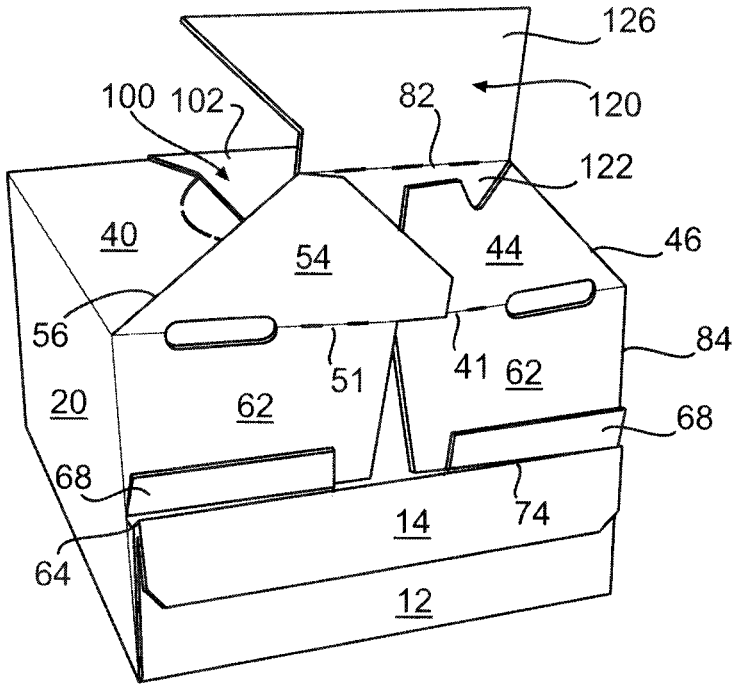
FIG. 3 illustrates the first carton embodiment in a partially erected state.
Figure 11:
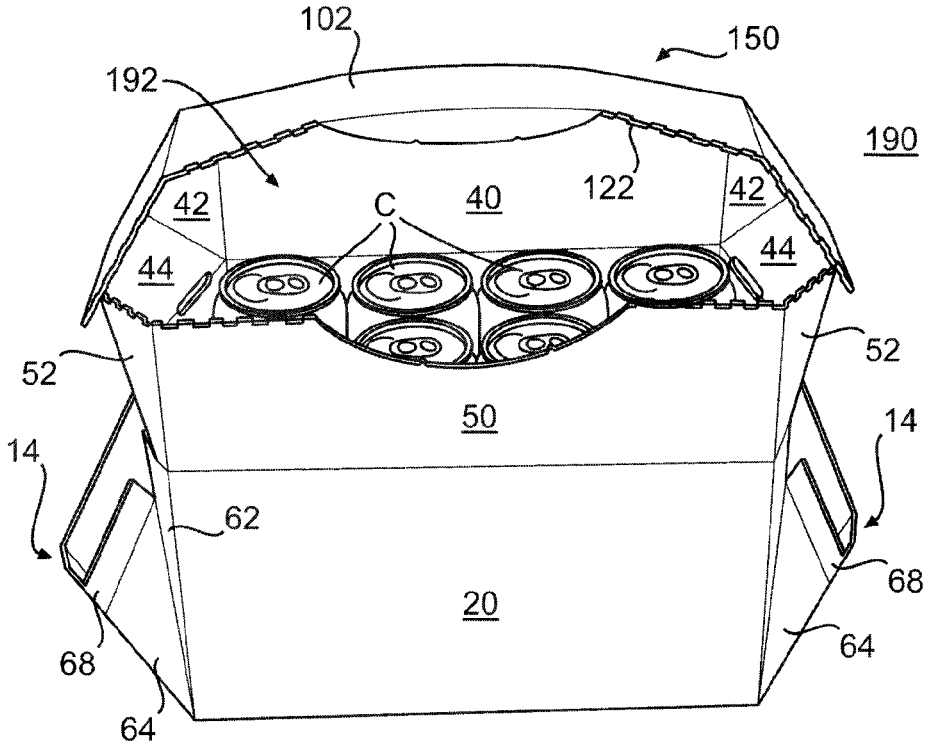
FIGS. 11-13 illustrate the first carton embodiment in the open configuration with the handle extended.
Figure 12:
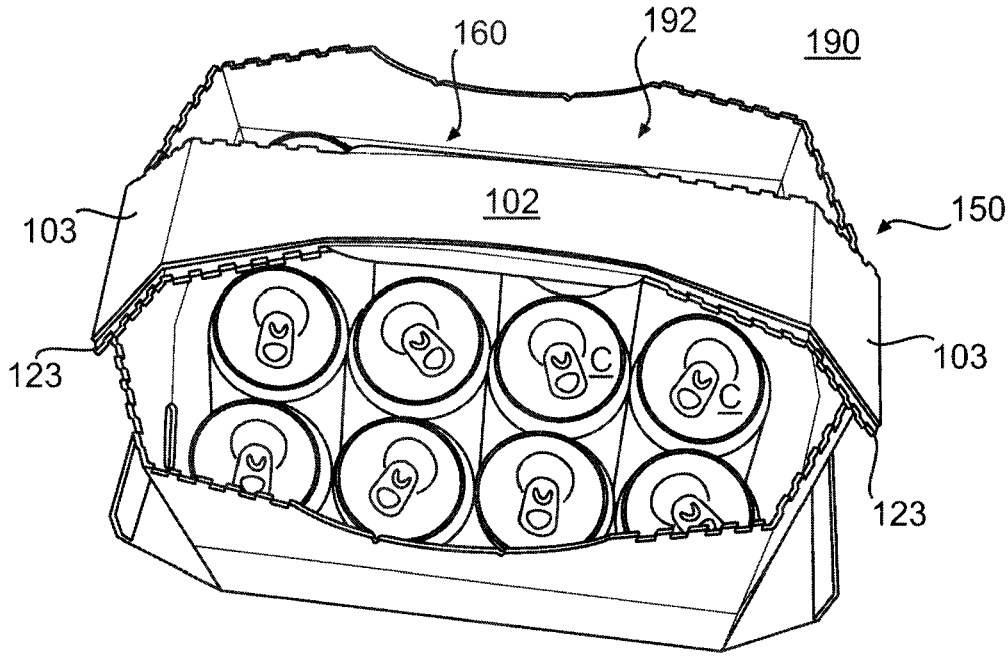
Figure 13:
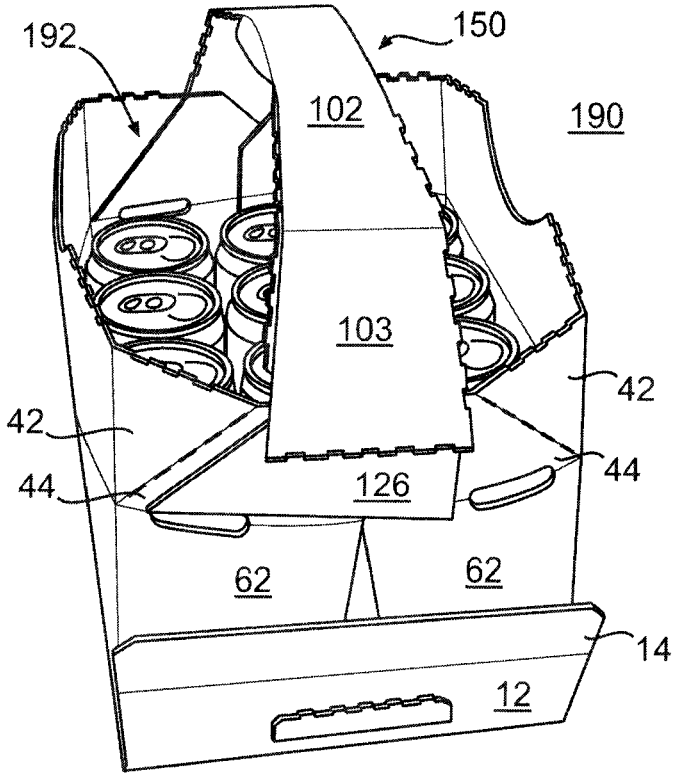

Referring to FIGS. 2 and 3, as the first and second bottom end flaps 12, 14 are pivoted upwardly in the direction of the arrow, the first exterior gusset panels 64 fold back over and overlap the interior gusset panels 62. The adhesive exterior gusset panels 68 end up extending upwardly as shown in FIG. 3. The interior gusset panels 62 are simultaneously pivoted about the fold lines 82, 84 so that they extend transversely across the open end of the carton. The upper gusset panels 44, 54 and 42, 52 are caused to pivot away from the open end of the carton so that they extend upwardly. The end portions of the adhered handle sections 100, 120 are pivoted upwardly along with the panels 44, 54, 42, 52. If desired, the interior side of the first bottom end flap 12 may be fixedly or removably (e.g., tacked) adhered to one or both of the exterior gusset panels 64. The flap 12 may remain unadhered to the panels 64 to allow for greater expansion of the carton 190 after opening (FIGS. 11-13). Referring specifically to FIG. 3, the second bottom end flap 14 is folded outward about the fold line 74 so that it overlaps the first bottom end panel 12.

Figure 4:
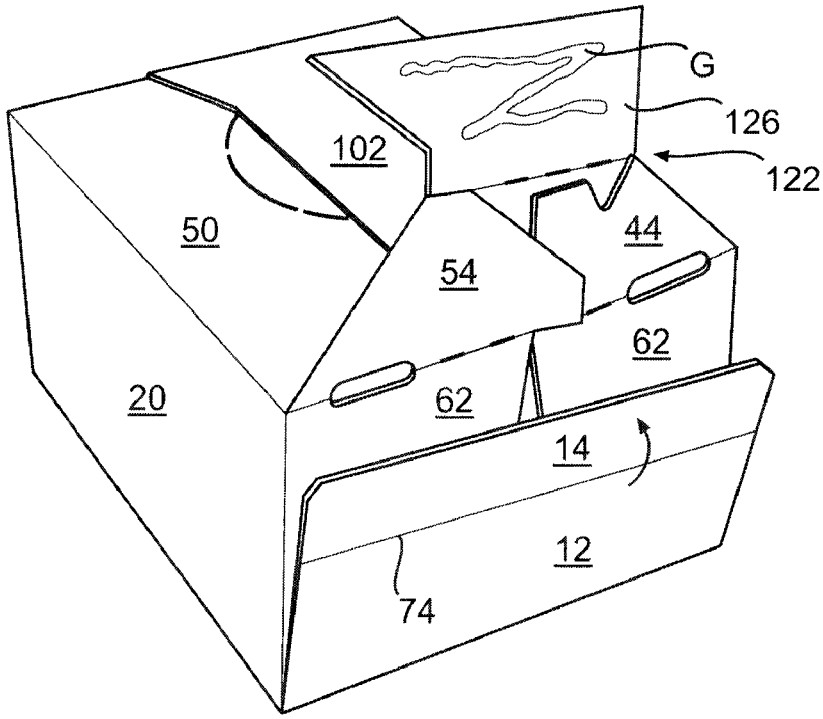
FIG. 4 illustrates the first carton embodiment in a partially erected state.

Referring to FIG. 4, glue G or other adhesive is applied to the underside of the distal section 126 of the first handle section 100. Adhesive may also be applied to the exterior surfaces of the upper gusset panels 44, 54. Glue or other adhesive is applied to the second exterior, adhesive gusset panels 68 (shown in FIG. 3), and/or to corresponding sections of the interior side of the second bottom end flap 14. The second bottom end flap 14 is pivoted upwardly and adhered to the adhesive gusset panels 68.

Figure 5:
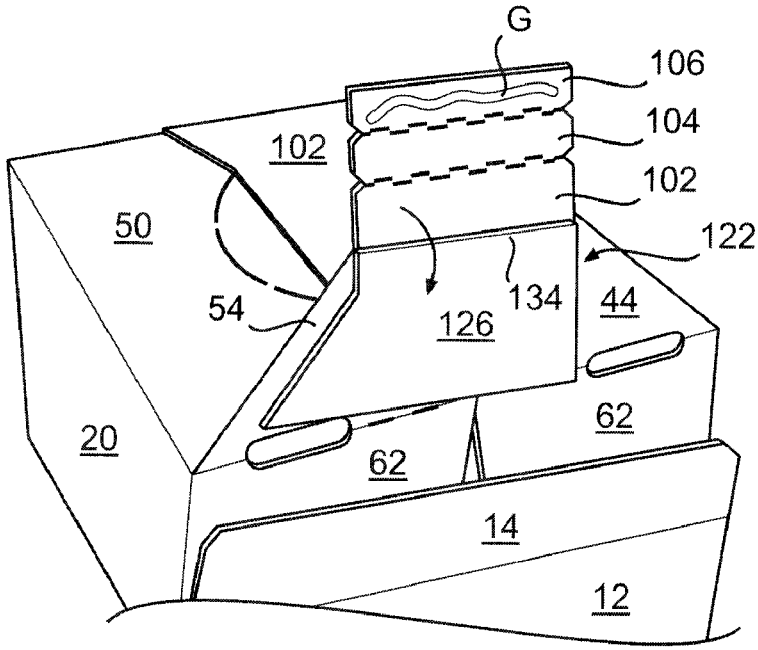
FIG. 5 illustrates the first carton embodiment in a partially erected state.

Referring to FIG. 5, the distal section 126 of the second handle section 120 is folded down about the fold line 134 and adhered to the upper gusset panels 44, 54. Glue G is then applied to the underside of the adhesive section 106 of the first handle section 102, or to a corresponding section of the exterior side of the flap 12. Referring also to FIG. 6, the upper gusset panels 42, 44, 52, 54 and the overhanging ends of the handle sections 100, 120 are folded downwardly so that the adhesive section 106 comes into contact with the first bottom end flap 12. The adhesive section 106 is adhered to the bottom end flap 12 to complete erection of the carton 190.

FIGS. 6 and 7 illustrate the erected carton 190. In the erected carton 190, the ends of the carton 190 are closed by gusseted end panels 180, and the first and second top panels 40, 50 are adhered together to form a top panel 170. The first and second handle sections 100, 120 are adhered together to form the extendable carton handle 150. The handle 150 extends across the top and ends of the carton 190, with the ends of the handle being adhered to the end panels 180 at the adhesive sections 106. The ends of the handle 150 are detachable from the ends of the carton 190 at the tear strips 104. The carton 190 may be, for example, parallelepipedal or generally parallelepipedal in shape.

Figure 8:
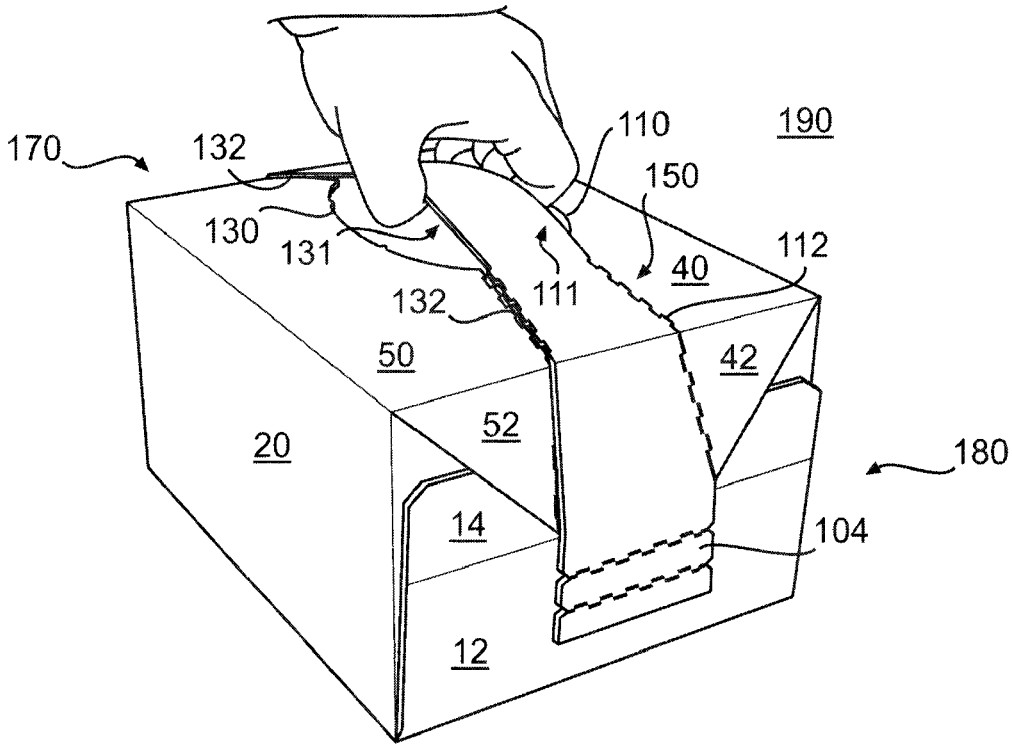
FIG. 8 illustrates the first carton embodiment being lifted by the carton handle.

FIG. 8 illustrates the carton 190 being lifted by the handle 150 before the carton 190 has been placed in its open or dispensing configuration. The carton 190 may be lifted, for example, by inserting one or more fingers into the top panel 170 at one or both of the curved access lines 110, 130, and then folding the resulting handle flaps 111, 131 inwardly. The curved access lines 110, 130 can include, for example, one or more breachable nicks to generally maintain the top panel 170 as a continuous planar surface, while also allowing easy breaching of the top panel 170 at the access lines 110, 130. Lifting the carton 190 by the handle 150 may result in partial tearing along the oblique tear lines 112, 132, particularly in the top panel 170, as shown in FIG. 8.

According to one aspect of the present invention, the carton 190 may be placed in its opened or dispensing configuration in which the top of the carton 190 is open and the length of the handle 150 is extended. Opening of the carton 190 and extension of the handle 150 is discussed below with reference to FIGS. 9 and 10.

Figure 9:
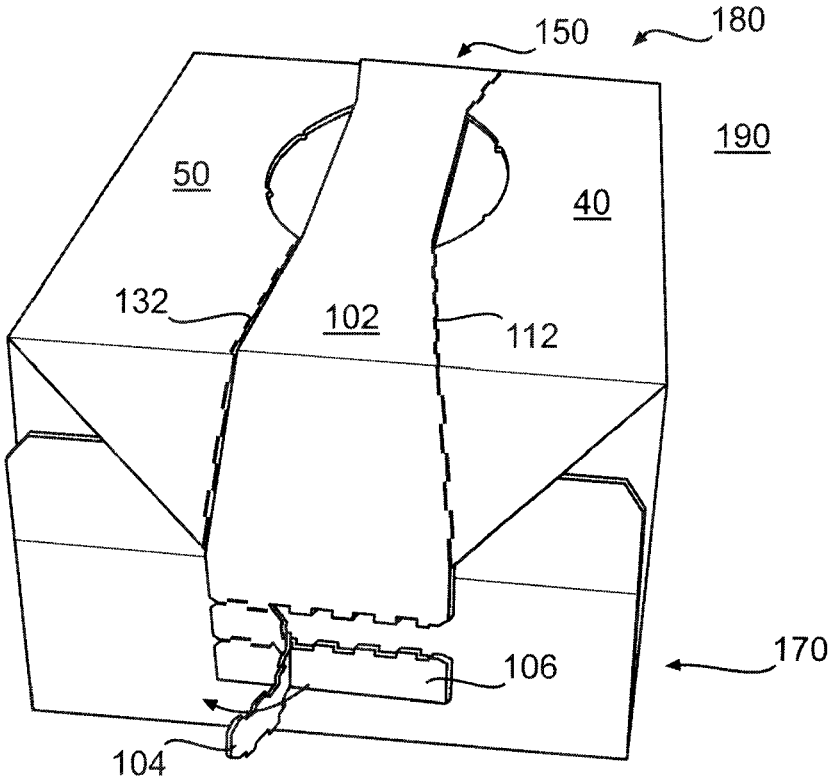
FIG. 9 illustrates the first carton embodiment being placed in an opened, dispensing configuration.
Figure 10:
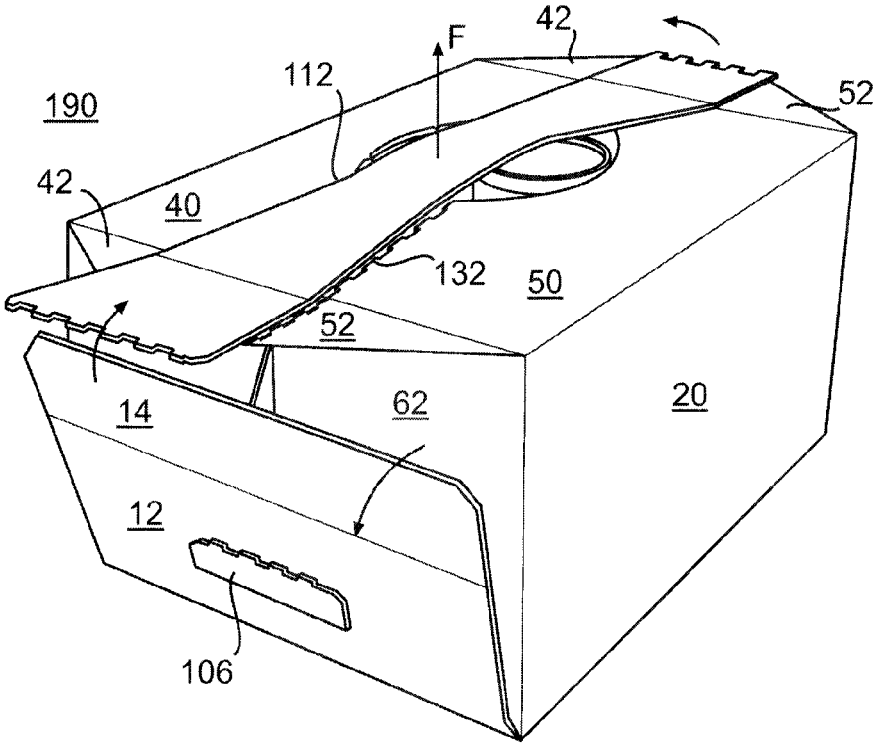
FIG. 10 illustrates the first carton embodiment being placed in the open configuration with the handle extended.

FIGS. 9 and 10 illustrate the carton 190 being placed in an open dispensing configuration via extension of the handle 150. Referring to FIG. 9, the tear strips 104 are removed to free the ends of the extendable handle 150 from the first bottom end flaps 12 at each end of the carton 190. Referring to FIG. 10, exerting a force F on the handle 150 causes the ends of the handle 150, along with the upper gusset panels 42, 52, to pivot upwardly. The first and second bottom end flaps 12, 14 also pivot outward slightly Referring to FIG. 11, further lifting up on the handle 150 causes the first and second handle sections 100, 120 to separate from the remainder of the first and second top panels 40, 50 along the tear lines 112, 132. Lifting the handle 150 also causes the remainders of the first and second top panels 40, 50 and the upper gusset panels 42, 44, 52, 54 to come into upright or generally upright positions.

FIGS. 11-13 illustrate the carton 190 in the open configuration with the handle 150 fully extended. As shown in FIG. 11, with the handle 150 disconnected from the first bottom end flaps 12, the bottom end flaps 12, 14 may pivot outwardly slightly as the interior gusset panels 62 and exterior gusset panels 64, 68 expand outwardly. The exterior adhesive gusset panels 68 remain adhered to the bottom end flaps 12 to maintain the bottom end flaps 12 in generally oblique upright expanded positions. After separation from the handle sections 102, 122, the remainder of the top panels 40, 50 extend generally upwardly as the handle 150 is pulled upwardly. The gusset panels 42, 44, 52, 54 also extend upwardly from the original plane of the unopened top panel 170 (illustrated in FIG. 6). The generally upright remainders of the top panels 40, 50 and the gusset panels 42, 44, 52, 54 thereby provide an expanded interior volume 160 to the carton 190 when the carton is placed in its dispensing configuration. The outwardly pivoted bottom end flaps 12, 14 and expanded gussets 60 further increase the interior volume 160.

The extended handle 150 is elevated with respect to the top edges of the panels 40, 50 and the gusset panels 42, 44, 52, 54. The handle 150 therefore creates little or no interference with access to the carton contents. The extended handle 150 may also be easily grasped and carried using a single hand.

Referring to FIG. 12, the gusset panels 62, 64, 66, 68 and the bottom end flaps 12, 14 at the bottom of the carton 190 at least partially close the bottom portions of the ends of the carton 190. The gusset panels 62, 64, 66, 68, the bottom end flaps 12, 14, and the panels 10, 20 define a partially closed bottom receptacle 192 in the bottom of the opened carton 190. Ice, cold water, additional containers, particulate matter, or other items, for example, can be placed in the bottom receptacle 192 through the opened top portion of the carton. The bottom receptacle 192 of the opened carton 190 can therefore be used to retain liquids, such as water formed from melting ice, condensation, other liquids, and articles such as, for example, refuse.

The bottom receptacle 192 includes no glued seams below the adhesion point of the adhesive gusset panels 68 to the second bottom end flaps 14, which corresponds to the top edges of the first bottom end flaps 12 at each end of the carton 190. The bottom receptacle 192 may therefore be characterized as "liquid-tight" below the top edges of the bottom end flaps 12. That is, in accordance with the first embodiment, no adhesive seal or other joinder of material where fluid might escape the carton 190 is located in the carton at a position below the top edges of the bottom end flaps 12. Referring also to FIG. 1, the bottom receptacle 192 may therefore be formed from a continuous section of folded material of the blank 8.

In a carton accommodating beverage containers C, the height of the top edges of the bottom end flaps 12 may be at least about ⅜ inches. In one embodiment, the height is at least one inch. The height may be increased, for example, to accommodate larger anticipated liquid volumes in the carton.

Figure 14:
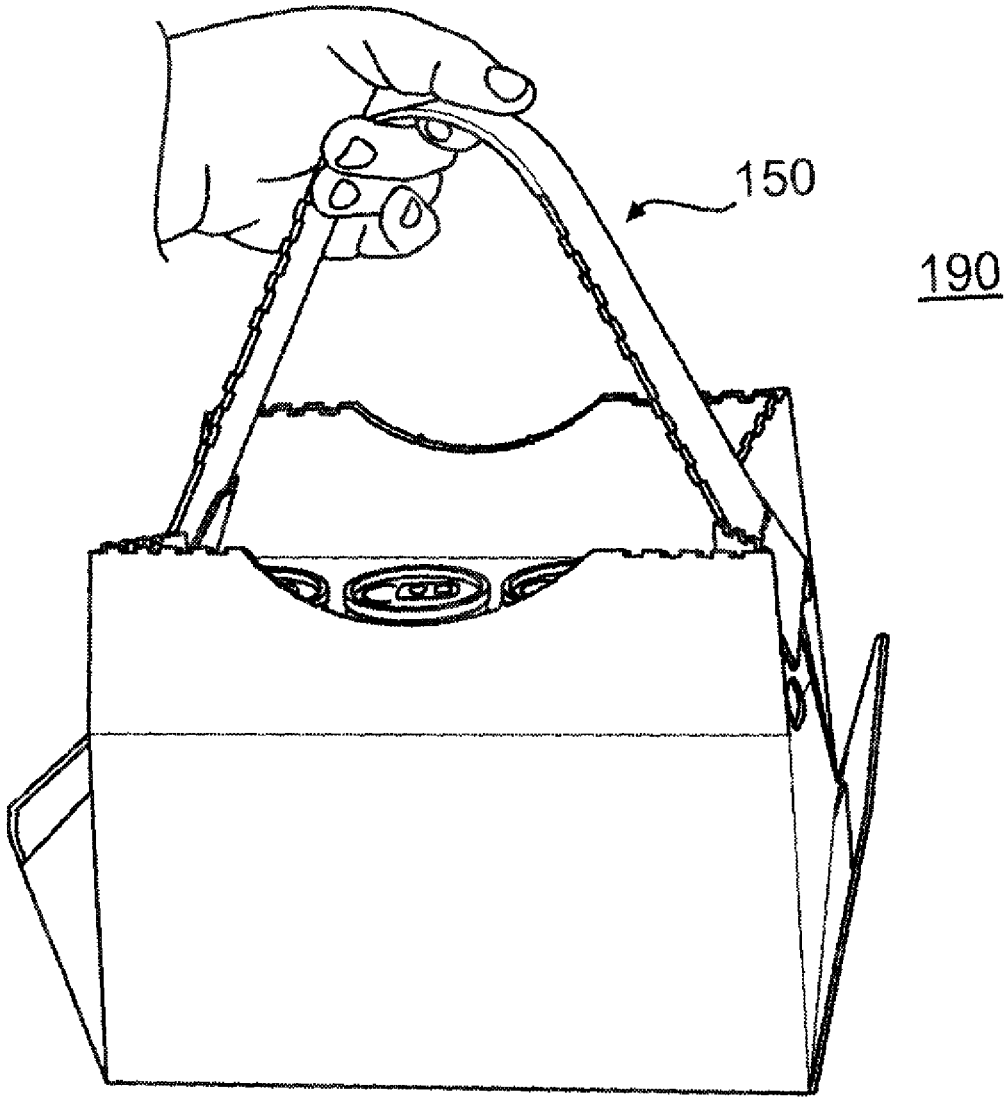
FIG. 14 illustrates the opened first carton embodiment being lifted by the extended handle.

FIG. 14 illustrates the open carton 190 being lifted by the extended handle 150. According to the above embodiment, the extendable handle 150 allows the carton 190 to be carried using only one hand, as shown in FIG. 14. The extendable handle 150 can be selected, for example, to have sufficient strength to carry the carton 190, containers C accommodated in the carton, and additional items such as ice or cold water loaded into the carton 190 after the carton has been opened. The extendable handle 150 may be extended to such a length so that the top is sufficiently open to allow additional items to be easily placed in and removed from the carton 190.

Figure 15:
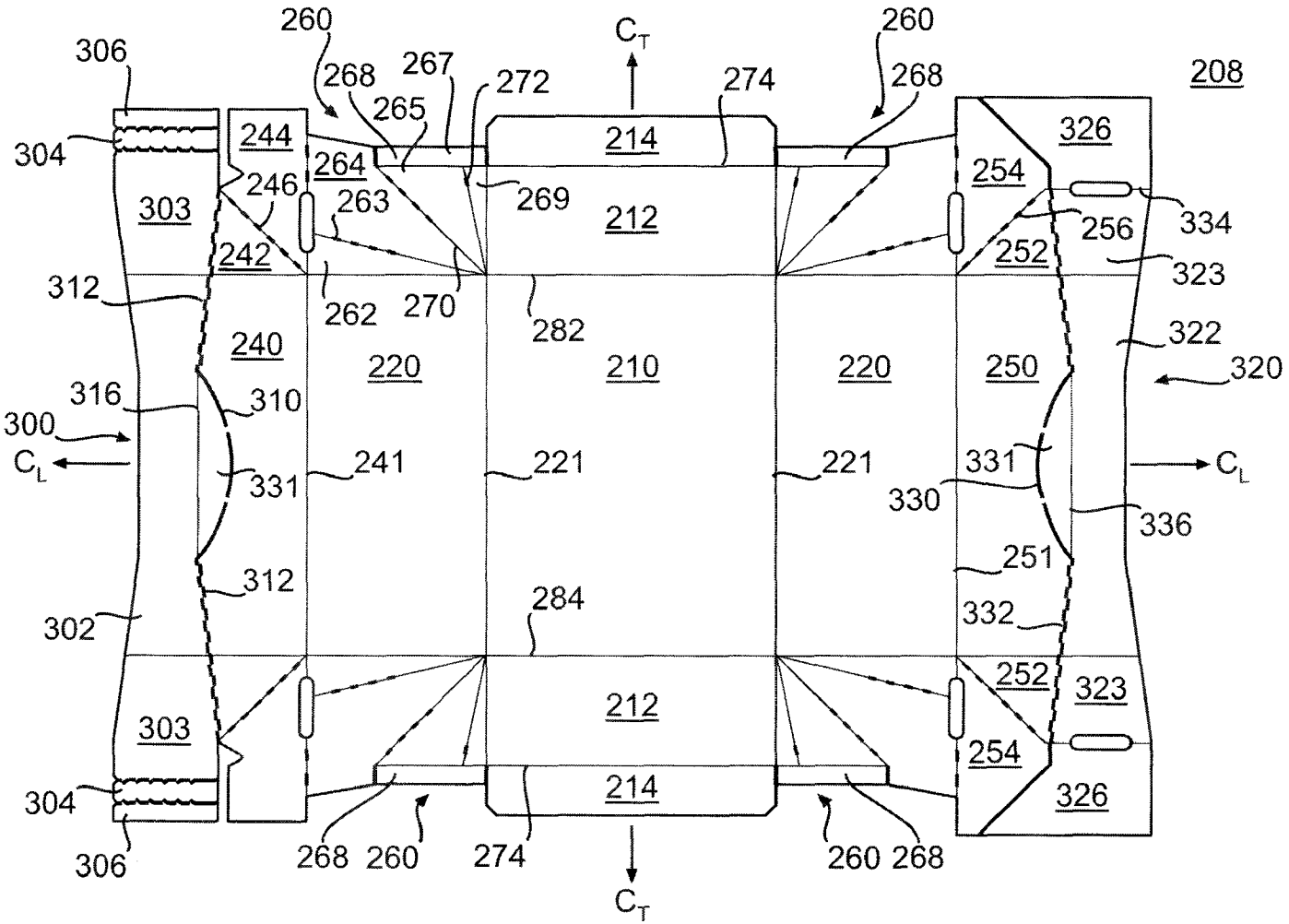
FIG. 15 is a plan view of a blank used to form a carton having a handle according to a second embodiment of the invention.

FIG. 15 is a plan view of a first side of a blank 208 used to form a carton (not shown) according to a second embodiment of the invention. As shown in FIG. 15, the blank 208 may have at least partial symmetry about a longitudinal center line $C_L$ and about a transverse center line $C_T$. The blank 8 is configured to form a carton for accommodating twelve containers C in a 3×4×1 (three columns and four rows) arrangement, although other container arrangements can be accommodated according to the principles of the present invention. The blank 208 may be similar to the blank 8 illustrated in FIG. 1, and like reference numbers in FIGS. 1 and 15 illustrate like or identical elements, with the reference numbers in FIG. 15 being preceded by a "2" or "3." The blank 208 may be formed into a carton in a manner similar to forming the blank 8 into the carton 190.

The blank 208 comprises a bottom panel 210 foldably connected to first and second side panels 220 at transverse fold lines 221, a first top panel 240 foldably connected to the first side panel 220 at a transverse fold line 241, and a second top panel 250 foldably connected to the second side panel 220 at a transverse fold line 251. First bottom end flaps 212 are foldably connected to opposite ends of the bottom panel 210 at first and second longitudinal fold lines 282, 284, respectively, and second bottom end flaps 214 are foldably connected to the first bottom end flaps 212 at longitudinal fold lines 274.

The carton blank 208 includes a first handle section 300 and a second handle section 320 formed in the first and second top panels 240, 250, respectively. The first and second handle sections 300, 320 overlap and combine to form a multi-ply extendable handle in a carton formed from the blank 208. The first handle section 300 is defined in part in the first top panel 240 by oblique tear lines 312 and a transverse fold line 316 connecting the tear lines 312. A curved access line 310 may be disposed along the side of the first handle section 300 at the fold line 316. The access line 310 and the fold line 316 define a handle flap 311. The first handle section 300 includes a central section 302, end sections 303, and distal adhesive sections 306 located at opposite ends of the end sections 303. The adhesive sections 306 are separable from the end sections 303 by tear strips 304. The second handle section 320 is defined in part in the second top panel 250 by oblique tear lines 332 and a transverse fold line 336 connecting the tear lines 332. A curved access line 330 may be disposed along the side of the second handle section 320 at the fold line 336. The access line 330 and the fold line 336 define a handle flap 331. The second handle section 320 includes a central section 322, end sections 323, and distal sections 326 connected to the end sections 323 by longitudinal cut-space fold lines 334.

Four bottom gussets 260 are formed in the blank 208, one at each corner of the bottom panel 210. The four bottom gussets 260 are foldably connected to a center portion of the blank 208 at the first and second longitudinal fold lines 282, 284. The bottom gussets 260 comprise interior gusset panels 262, 264, exterior gusset panels 265, 269, and adhesive exterior gusset panels 268, defined by fold lines 263, 270, 272, 221, 282, 284, 274, 241, 251. In the carton formed from the blank 208, the adhesive gusset panels 268 are adhered to interior sides of the second bottom end flaps 214, as shown in the context of the blank 8 illustrated in FIG. 4.

The first top panel 240 includes a pair of first upper gusset panels 242, 244 foldably connected at opposite ends of the first top panel 240. The first upper gusset panels 242 are foldably connected to a central section of the blank 208 at the first and second longitudinal fold lines 282, 284. Each first upper gusset panel 242 is foldably connected to an adjacent upper gusset panel 244 at an oblique fold line 246. The second top panel 250 includes a pair of second upper gusset panels 252, 254 foldably connected at opposite ends of the second top panel 250. The second upper gusset panels 252 are foldably connected to a central section of the blank 208 at the first and second longitudinal fold lines 282, 284. Each second upper gusset panel 252 is foldably connected to an adjacent panel 254 at an oblique fold line 266.

In the above embodiments, cartons are described as accommodating 12 ounce beverage cans. Other types of containers, however, can be accommodated within cartons according to the present invention. The cartons accommodate twelve containers C in a 3×4×1 arrangement. Additional containers C can be accommodated, however, by adjusting the geometry of the blanks.

The blanks discussed above can, for example, be constructed of water resistant material to any degree desired so that liquid in the bottoms of the cartons formed therefrom remains in the bottom receptacle for a selected amount of time.

Cartons according to the principles of the present invention may be formed from materials such as paperboard. Therefore, if exposed to water or other liquids for extended periods of time, the carton may allow for the passage of liquid through the wetted carton surfaces due to partial permeability of the carton material. In this specification, the term "liquid-tight" is generally used to define a section of a carton that is formed from a continuous section of material or of a section without any glued seams through which liquid or fine particulate matter might leak, and the term "liquid-tight" therefore encompasses cartons that may become partially water permeable over time.

In accordance with the above-described embodiments, the blanks may be constructed of paperboard of a caliper such that they are heavier and more rigid than ordinary paper. The blanks can also be constructed of other materials, such as cardboard, hard paper, or any other material having properties suitable for enabling the cartons to function at least generally as described above. The blanks can also be laminated to or coated with one or more sheet-like materials at selected panels or panel sections. Interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiment of the present invention, a fold line can be any substantially linear, although not necessarily straight, form of disruption or weakening in the blanks that facilitates folding therealong. More specifically, but not for the purpose of narrowing the scope of the present invention, examples of fold lines include: score lines; crease lines; a cut or a series of cuts that extend partially into and/or completely through the material along a desired line of weakness; and various combinations of these features.

In the present specification, a "panel" or "flap" need not be flat or otherwise planar. A "panel" or "flap" can, for example, comprise a plurality of interconnected generally flat or planar sections.

For purposes of the description presented herein, the term "line of disruption" can be used to generally refer to, for example, a cut line, a score line, a crease line, a tear line, or a fold line (or combinations thereof) formed in a blank. A "breachable" line of disruption is a line of disruption that is intended to be breached during ordinary use of the carton. An example of a breachable line of disruption is a tear line.

The above embodiments may be described as having one or panels adhered together by glue during erection of the dispensing carton embodiments. The term "glue" is intended to encompass all manner of adhesives commonly used to secure dispensing carton panels in place.

The description is not intended to limit the invention to the form disclosed herein. Also, it is intended that the appended claims be construed to include alternative embodiments, not explicitly defined in the detailed description.

What is claimed is:

1. A carton, comprising:

a top panel comprising a first top panel and a second top panel;

a bottom panel;

a first side panel;

a second side panel;

a first end panel;

a second end panel; and an extendable handle for carrying the carton and being formed at least in the first and second top panels and the first and second end panels, the handle comprising a central section extending across the top panel, a first end section in the first end panel, and a second end section in the second end panel, wherein at least a portion of the first end section of the handle is detachably connected to the first end panel and at least a portion of the second end section of the handle is detachably connected to the second end panel, wherein the handle comprises a first handle section of the first top panel and a second handle section of the second top panel, wherein the first and second handle sections are overlapped and adhered together, wherein the first handle section is defined in part by tear lines in the first top panel and the second handle section is defined in part by tear lines in the second top panel, whereby separation of said handle sections from said top panels along said tear lines and detachment of said end sections of said handle from said end panels allows said top panels to move to an open position and said handle to be extended upwardly for use in carrying said carton.

2. The carton of claim 1, wherein the first top panel includes first upper gusset panels adjacent to the first handle section, and the second handle section includes a distal section, the distal section being adhered to at least one of the first upper gusset panels.

3. The carton of claim 1, wherein the first end section of the handle is detachably connected to the first end panel at a first tear feature.

4. The carton of claim 3, wherein the first handle section includes a first distal section detachably connected to the tear feature, the first distal section being adhered to the first end panel.

5. The carton of claim 4, wherein the first end panel includes a pair of bottom gussets, each bottom gusset being foldably connected to the first end panel and one of the side panels.

6. The carton of claim 5, wherein the first top panel includes a plurality of upper gusset panels, at least one of the upper gusset panels being foldably connected to one of the bottom gussets.

7. The carton of claim 1, wherein the first end panel includes a pair of bottom gussets, each bottom gusset being foldably connected to the first end panel and one of the side panels.

8. The carton of claim 7, wherein the first top panel includes a plurality of upper gusset panels, at least one of the upper gusset panels being foldably connected to one of the bottom gussets.

9. The carton of claim 7, wherein a bottom receptacle of the carton is liquid-tight.

10. The carton of claim 7, wherein the first top panel overlaps the second top panel, the handle comprising at least two plies where the first top panel and the second top panel overlap.

11. A carton blank, comprising:

a first top panel, the first top panel including a first handle section defined therein, the first handle section comprising a central section extending across the top panel and a first end section forming at least a portion of a first end panel of a carton formed from the blank, the first handle section including a first distal section detachably connected to the first end section, the first handle section further comprising a second end section forming at least a portion of a second end panel of a carton formed from the blank and a second distal section detachably connected to the second end section, wherein the first distal section is detachably connected to the first end of the first handle section at a first tear feature, wherein the first handle section is defined in part by tear lines in the first top panel and the second handle section is defined in part by tear lines in the second top panel whereby in a carton formed from said blank, separation of said handle sections from said top panels along said tear lines and detachment of said end sections of said handle from said end panels allows said top panels to move to an open position and said handle to be extended upwardly for use in carrying said carton;

a second top panel, the second top panel including a second handle section defined therein;

a bottom panel;

a first side panel;

a second side panel;

at least one first bottom end flap; and at least one second bottom end flap.

12. The carton blank of claim 11, further comprising a pair of bottom gussets at a first marginal area of the blank, each bottom gusset being foldably connected to the first bottom end flap and one of the side panels.

13. The carton blank of claim 12, wherein the first top panel includes a plurality of upper gusset panels, at least one of the upper gusset panels being foldably connected to one of the bottom gussets.

14. The carton blank of claim 11, wherein first handle section is defined in part by tear lines in the first top panel and the second handle section is defined in part by tear lines in the second top panel.

15. The carton blank of claim 11, further comprising:

a pair of bottom gussets at a first marginal area of the blank, each bottom gusset being foldably connected to the first bottom end flap and one of the side panels, wherein the first top panel includes a plurality of upper gusset panels, at least one of the upper gusset panels being foldably connected to one of the bottom gussets.

16. The carton of claim 1, wherein the handle comprises a handle flap in the first top panel and the handle is at least partially defined by a tear line extending from the handle flap at least partially across the first top panel and into the first end panel.

17. The carton of claim 1, wherein the first handle section is detachably connected to a first portion of the first end panel and the second handle section is adhered to a second portion of the first end panel.

18. The carton of claim 2, wherein the first upper gusset panels are detachably connected to the first handle section at a tear line.

19. The carton of claim 3, the first end panel comprising a first bottom end flap foldably connected to the bottom panel, the first end section of the handle being detachably connected to the first bottom end flap.

20. The carton of claim 3, the first tear feature being a tear strip.

21. The carton blank of claim 15, wherein the first upper gusset panels are detachably connected to the first handle section at a tear line.

22. The carton blank of claim 21, wherein the first handle section comprises a handle flap in the first top panel and the tear line extends from the first upper gusset panels to the handle flap.

23. The carton blank of claim 11, the first tear feature being a tear strip.

* * * * *